US005140972A

United States Patent [19]

Fisk

[11] Patent Number: 5,140,972

[45] Date of Patent: Aug. 25, 1992

[54] OVERDRAW EXTENSION FOR COMPOUND BOWS

[76] Inventor: Roger A. Fisk, 9225 E. Edger Rd., Vestaburg, Mich. 48891

[21] Appl. No.: 700,405

[22] Filed: May 15, 1991

[51] Int. Cl.[5] ..... F41B 5/00

[52] U.S. Cl. ..... 124/44.5; 124/24.1; 124/88

[58] Field of Search ..... 124/23.1, 24.1, 25.6, 124/44.5, 86, 88, 90

[56] References Cited

U.S. PATENT DOCUMENTS 4,027,645 6/1977 Damron ..... 124/24.1
4,446,844 5/1984 Nishioka ..... 124/44.5
4,829,974 5/1989 Anderson ..... 124/24.1
5,022,378 6/1991 Rhodehouse et al. ..... 124/445
5,025,773 6/1991 Hintze et al. ..... 124/44.5

*Primary Examiner*—Randolph A. Reese
*Assistant Examiner*—John A. Ricci
*Attorney, Agent, or Firm*—Miller, Morriss & Pappas

[57] ABSTRACT

An overdraw structure for compound bows which extends the arrow rest rearwardly at a predetermined point in the draw and which returns the carriage for the arrow rest in the line-of-sight as the bowstring is released.

7 Claims, 3 Drawing Sheets 14
19
15
20
17
28
16
24
18
27
22
23
33
25
30
29
11
26
13
12

OVERDRAW EXTENSION FOR COMPOUND BOWS

The present invention is a new, useful and nonobvious overdraw structure for compound bows using bow limbs that are strung with cables over high energy or cam-like wheels and which cables are generally ahead of and in the plane of the main drawstring. The present overdraw structure is attachable to the side or upright of the handle riser portion of the bow and extends in a somewhat channel-like configuration rearwardly from the handle. The overdraw mechanism is thus secured to the handle. Most compound bows include one or more tapped holes which allow adjustable attachment of the overdraw extension to the bow and its alignment with whatever sighting means or accessories may be employed. Arrow rests or supports are provided on the overdraw units of the present invention and the rests are adjustable and gapped to assure substantially frictionless engagement with the arrow and keeps the arrow out of contact with the bow surfaces. The gap allows passage of the fletching of the arrows.

There are many variants of compound bows and most are provided with a tapped mounting hole through the cheek of the grip or handle and the overdraw unit, as presently presented, is generally channel shaped and includes guide rails or ways within the channel and a separate carriage rides on the guide rails and is resiliently biased in a forward direction within the channel-like frame. A tether is connected to and extends from the rear of the carriage and the tether is attachable to the cable elements of the bow. The cable elements extend from over the high energy wheels or cam wheels of the bow. Thus, when the drawstring with arrow in nocked relation is drawn backward by the archer, the cables move rearwardly and as the limbs of the bow are drawn or pulled, the cables move rearwardly. During movement of the drawstring, the tether, (at a preselected point) will become taut and the resilient bias on the carriage will be overcome and the carriage will move rearwardly against the bias.

This permits a substantial extended movement of the arrow beyond that movement permitted by the length of the arrow. During this movement of the carriage by the tether the guide rails or ways assure a smooth displacement and controlled movement in its support cradle. The extended movement maintains the initial alignment of the arrow.

At release of the arrow by the archer in accord with his sight determinations, the carriage moves forward obeying the bias applied thereto and in parallel relation to the line of flight of the arrow. The arrow rest moves with the carriage and this movement of the carriage releases or substantially minimizes the frictional engagement of arrow to bow via the arrow rest. The consequence is an unexpected enhancement of power in the launching of the arrow at greater initial velocities and resultant relatively flat trajectory. Neither the bow string nor the cables contact the bow or overdraw structure since the initial rearwardly projected carriage is in its full extension forward in the channel frame and the strings and cable are not extended that far. The release is smooth and the flight velocities are extended by removal of arrow flex and a lighter, shorter arrow is thus made available to the archer.

BACKGROUND

Overdraw devices for archery bows found principal utility with compound bows in which the terminal outer ends of the bow limbs support high energy or cam-like wheels to which are strung cables moving generally in the plane with the drawstrings and rearwardly as the nock of the arrow is drawn rearwardly. The cam wheels and cables allow for easier drawing of the bow and better energy storage in the limbs of the compound bows.

Overdraw structures have become most useable in compound bows in order to provide draw rearwardly beyond that accommodated by a simple arrow rest on the hand of a user or a rest post immediately adjacent the handle area and in most instances are an extension of the handle. Such an overdraw adds power but increases danger to the user since the arrow in the overdraw structure is poised on some support surface in danger of being exceeded in the draw if too short of an arrow is used. Typical of prior art overdraw devices are the overdraw devices of Benny Sears in U.S. Design U.S. Pat. No. 313,059 and the overdraw system of Marlow Larson in U.S Pat. No. 4,879,988. The former simply shows a channel shaped base element and an integral arrow support element extending transversely of the channel. The latter also provides a channel-like extension and a selectively locatable arrow support element. The arrow rest portions in Sears may be selectively fixed in a particular location on the carriage.

None of the overdraw devices of the prior art as known include a precision movable carriage upon which gapped arrow support elements are mounted with the carriage biased to a forward position and in which the bias may be overcome depending upon the extent of the draw as by a tether on the carriage which is attached to a part of the bow, as for example the draw string or the cables, and set for length as desired to provide a moving arrow support in a precision alignment with the original arrow rest position and then upon release the frictional influence on the arrow by the support is reduced by the forward movement of the carriage and rest, with the consequence of the arrow moving in an improved parallelity to the line of flight.

OBJECTS

Thus the present invention extends the overdraw by providing a moving arrow support carriage in a track-like receiver provided with precision guideways assuring the lineal movement of the carriage on draw and, on release the carriage and rest are in forward progress with release of the drawstring.

Other objects, including friction reduction ways in precision control of movement, and adjustability of the arrow support and the receiver, in reference to the bow handle, will also be appreciated as the description proceeds.

In addition, the simplicity of the structure is easily appreciated and the structure is ruggedly durable and particularly attractive to hunters used to rough terrain and close standing quarters.

Other objects and advantages including economical design and amenability to precision cast parts will be appreciated by those skilled in the art as the description proceeds.

IN THE DRAWINGS

Figure 1:
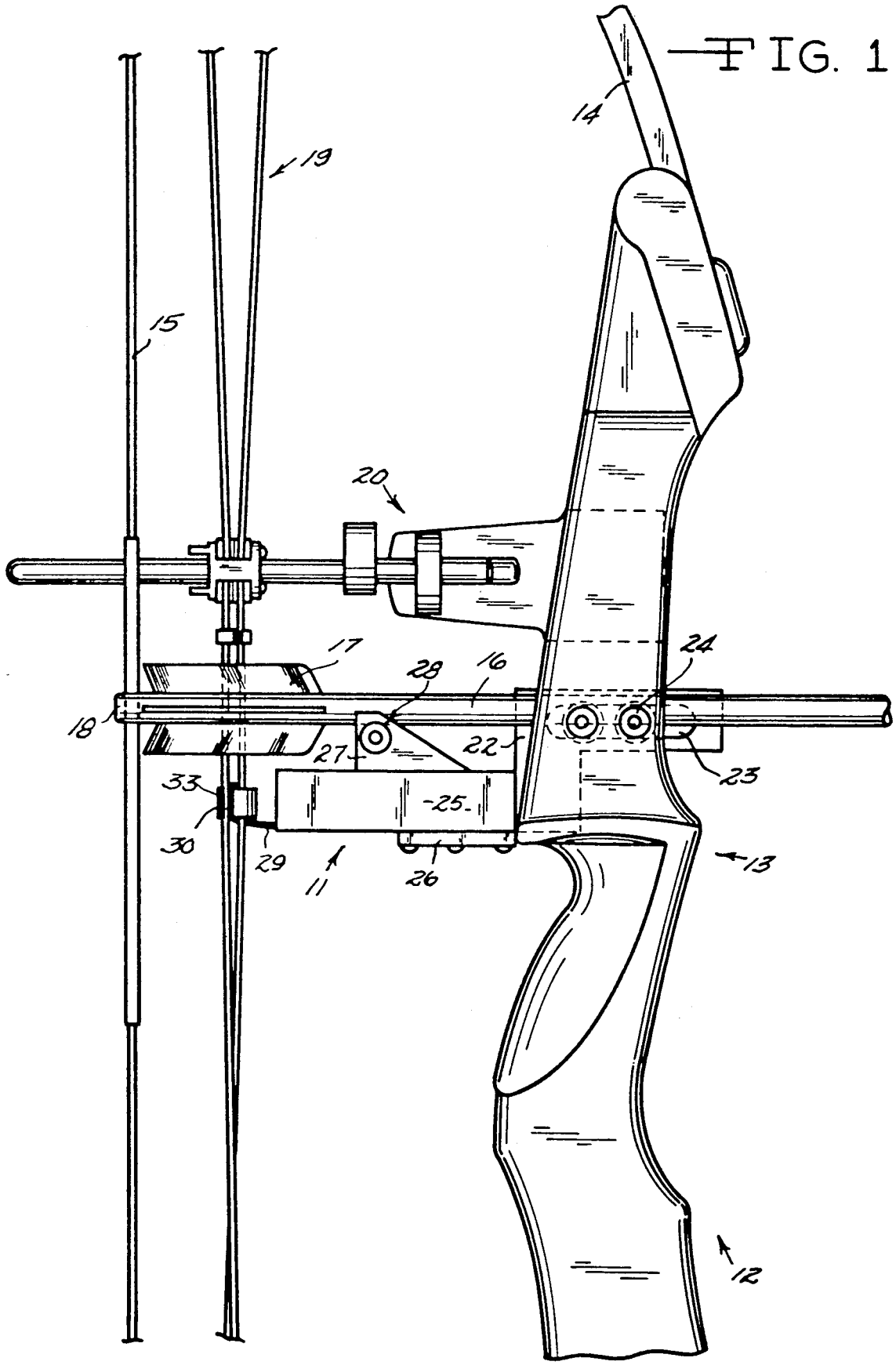
FIG. 1 is a partial side elevation view of a typical compound bow taken at the handle portion of the bow and indicating the bow limbs, the cam or cam-wheel cables, the drawstring, a typical sight, and arrow, the arrow resting on an arrow rest in the carriage of the present invention and the carriage mounted in the receiver and the overdraw structure adjustably secured to the bow at the handle.
Figure 2:
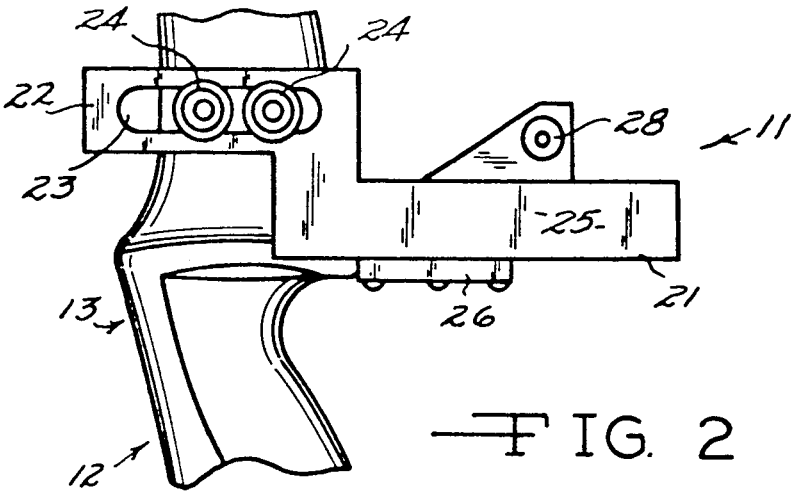
FIG. 2 is a partial side elevation at the bow handles opposite the view of FIG. 1 and showing the receiver of the overdraw structure adjustably and firmly mounted to the bow via the slotted extension and the carriage and its adjustable arrow support or rest is seen in the receiver.
Figure 3:
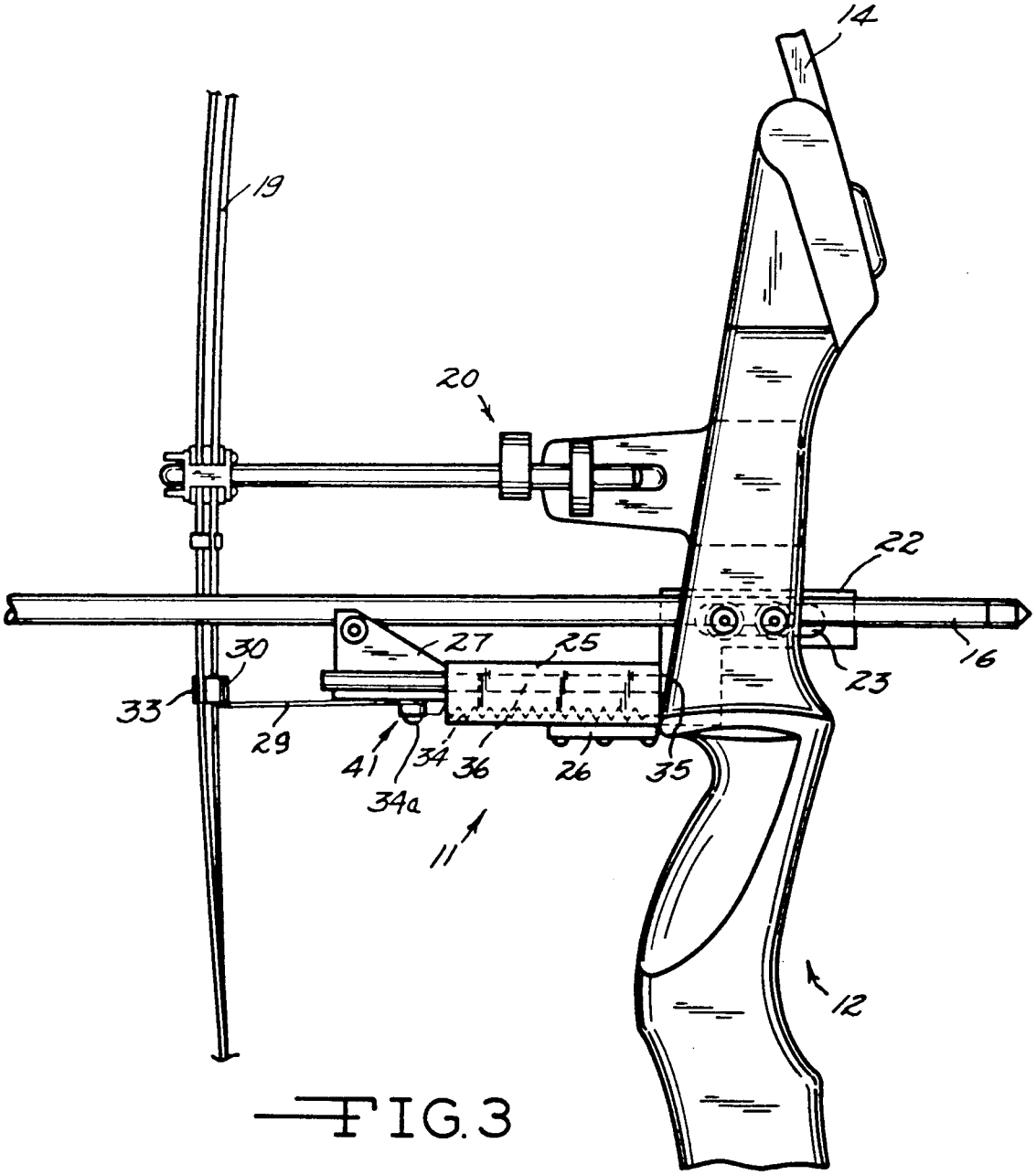

FIG. 3 is a partial side elevation of the overdraw structure shown in FIGS. 1 and 2 but with the carriage retreated in the ways of the receiver as the drawstring of the bow moves the cables of the bow rearwardly against the bias of the carriage return spring and the drawstring augmented by; the cables moving the carriage by means of the tether connected to the cables as by means of a cable block or connection.

Figure 4:
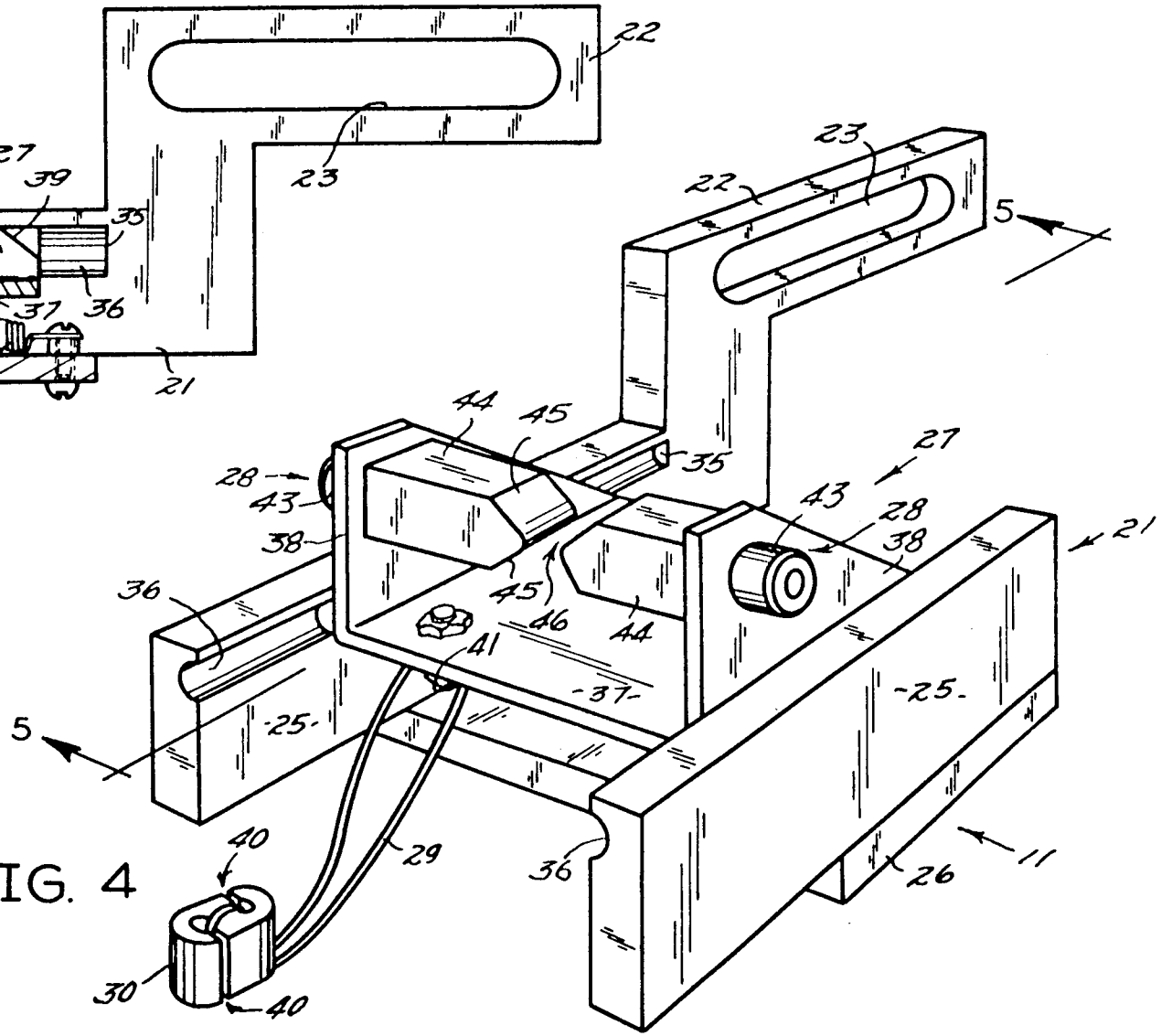

FIG. 4 is a perspective view of the overdraw structure of the present invention and indicating the ways or guides between the receiver and the carriage in an antifriction relationship on the Teflon rail elements riding in the grooves as shown. The tether is secured to the base of the carriage and is terminally attached to a slotted cable block or fastener. The arrow support is gapped, as shown, and adjustably positionable in the carriage.

Figure 5:
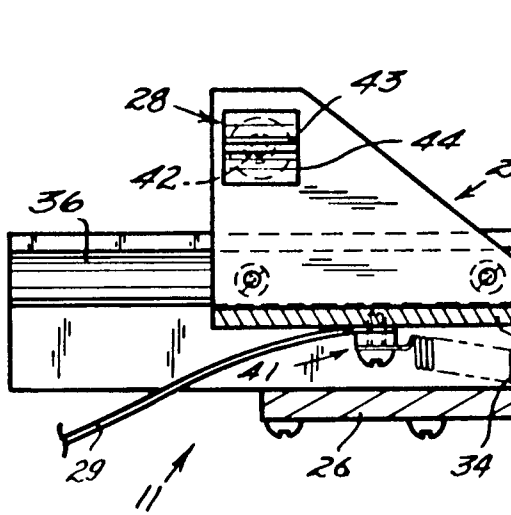

FIG. 5 is a section view through the structure of FIG. 4 on the line 5—5 thereof, and best indicates the spring bias urging the carriage forwardly in the receiver and indicating the ways and the antifriction journalling of the carriage in the ways.

GENERAL DESCRIPTION

In general, the present invention includes a receiver which is adjustably attachable to the handle portion of the bow to establish a path parallel to the line of sight and in register with the plane of the drawstring as generated in drawing the bow and in releasing the string. In compound bows, cables between the limb extremities extend generally vertically and are generally in planes parallel to the drawstring. The cables are moved by the limbs of the bow as the drawstring is pulled back by the archer and the quantum of pull is increased by the pulley and wheels mounted on the limbs of the bow and coordinated by the cables running therebetween. This compound bow construction provides a substantial increase in power in this type of bow and reduces the required power draw by the archer but such reduction of power input by the archer results in substantial increase in movement of the drawstring. Thus the present invention is desireable so as to permit the extension of draw in respect to a selected length of arrow. Other arrow rests may be selected provided the gapping is observed. The carriage of the present invention is guideably controlled in precision made and relatively frictionless guideways. The carriage carries the adjustable arrow rests or supports which extend in a gapped transverse direction across the line of movement of the carriage. The gapping permits fletching to travel with minimum engagement with the rest elements. Once established, the line of flight is accurately controlled. The tips of the arrow supports are preferably Teflon material having a low friction interface with the arrow.

Spring means normally bias the carriage of the overdraw structure forwardly on the receiver and against a barrier. A tether extends rearwardly of the carriage and connector means are provided for adjusting the length of the tether and connecting the tether to a part of the bow movable rearwardly as the bow is drawn. This connection is preferably to the cables or drawstrings so that at a selected draw the bias of the carriage connected spring is overcome and the carriage retreats from the barrier as the arrow is retreating. This permits a substantial overdraw as wished by the archer and the archer avoids substantial danger to himself since the arrow support or rest is retreating with the arrow after a selected amount of movement determined by the tether length. Upon release of the drawstring the arrow is launched and the bias against the carriage to return to the barrier materially reduces friction at the rest interface as the arrow achieves its full velocity. This minimizes deviation in arrow flight from the line of launching.

SPECIFIC DESCRIPTION

Referring to the drawings and the preferred embodiment of the invention, as therein illustrated, the FIG. 1 shows overdraw structure 11 mounted on a left hand compound bow 12 or right hand bow (not shown) at the handle or grip portion 13, thereof. In compound bow 12 the limbs 14 (only upper limb 14 is showing) are of substantial strength, are replaceable and may be of steel, laminated wood and plastic materials and in some instances graphite or other materials and combinations thereof suitable to store high energy for projection of arrows 16 upon release of the drawstring 15.

The arrow 16 with fletching 17 and nock 18 is moved forwardly of the bow 12 (to the right in the drawing). Intermediate the drawstring 15 and the bow 12 the compound bows 12 usually include a pair of cables 19 which are strung from (high energy wheels, cams, cam-wheels or pulleys) (not shown) mounted at the ends of the limbs 14 and which cables 19 generally are parallel in a plane which includes drawstring 15, bow 12 and arrow 16. The handle or grip 13 usually includes means for mounting sights 20 or accessory elements. To the bow 12 the overdraw structure 11 is adjustably attached and the receiver portion 21 of the overdraw structure 11 includes an extension arm 22 which includes a slot 23 mounted in horizontal attitude to the handle 13 by removable fasteners 24. Some bows 12 have only a single fastener 24. The receiver 21 has a generally channel shaped configuration in which upturned flange plates or sides 25, in spaced apart relation, are provided with internally facing ways, such as grooves and the plates 25 are joined at the base by a web portion shown as base block 26. Between the plates 25 and travelling lengthwise in the receiver 21 is a carriage 27. The carriage 27 is biased toward the front or bow side of the receiver 21 and the carriage 27 as will be seen is movable guidably in the grooves or slots in an antifriction manner. The carriage 27 carries arrow rest or support means 28 and the arrow support means 28 is movable with the carriage 27. As will be seen the bias means in the preferred embodiment are springs between the receiver 21 and carriage 27. A stop, as later will be seen, limits the forward travel of the carriage 27 as urged by the resilient bias. A tether 29 shown as a woven wire means is adjustably connected to the cables 19. The connection is accomplished, as shown, by a tough plastic block 30 attached to the tether 29 as by means of the vertical slots 33 in the block 30 into which the cables 19 are sprung.

In the FIG. 1 a left hand bow 12 is illustrated and it will be appreciated that receiver 21 is secured to the bow 12 by the extension arm 22 which projects forwardly as an extension of the left plate or side 22 or of the arrow 16 in a position out of contact with the bow 12 and resting on the arrow support 28. The arrow 16 is thus nocked on the drawstring 15 and the tether 29 is secured at a selected interval to the cables 19 by the plastic block 30 so that the carriage 27 of the overdraw structure 11 moves rearwardly as the bow 12 is bent at a point when slack in the tether 29 is exhausted and at that point the carriage 27 moves with the rearward monument of the cables 19 so that an arrow 16 of specified length may move safely to the rearmost position possible without engaging the head (not shown) of the arrow 16. Upon release of the drawstring 15, the arrow 16 is projected forward of the bow 12 and the carriage 27, freed from the rearward movement of the cables 19, is urged by the resilient bias in a forward parallel direction in the receiver 21 with substantially frictionless drag on the arrow 16 arrow to launch.

In the FIG. 2 the bow 12 has been reversed so that the extension arm 22 of the receiver plate 25 of receiver 21 best shows the slotted portion 23 of the extension arm 22 which permits selective adjustment to the bow 12 and the fasteners 24 are visible, locking the overdraw structure 11 into its use position for establishing the movement of the carriage 27 with its arrow support rest element 28. The base block 26 provides the web-like floor for the flange plates 25 which establish the positioning path of the ways, as will be seen.

The FIG. 3, like the FIG. 1 provides a view of the overdraw structure 11 in its use posture on a bow 12 from the arrow-side of the bow 12. In the FIG. 3 the bow 12 has been drawn and the drawstring 15, in the nock of the arrow 16 has applied force to the limbs 14 of the bow 12 and in the bending the cables 19 have moved with the movement of the draw string 15 and upon such movement the cables 19, via block 30 according to the adjusted lengths of tether 29, pull on the carriage 27 by means of the tether 29 and against the resilient bias of spring 34 acting on the carriage 27 acting to drive the carriage 27 toward the front of the receiver 21. Thus the spring 34 normally urges the carriage 27 forwardly against the block or buttress 35 at the forward end of the ways 36 which guide the carriage 27 in a fixed substantially horizontal path as shown. The carriage 27, upon launching the arrow 16, under the persuasion of the spring means 34 (secured at fastener **34*a*), moves with the arrow 16 in a forward direction in the receiver 21 to stop position against the block or buttress 35 minimizing any frictional reactions of the arrow 16 against the bow 12 and, as will be seen, the arrow 16 moves off of the rest 28 in a dynamic manner (carriage 27 and arrow 16 both in motion) with fletching 17 of the arrow 16 traversing the observed gap between the rest elements 28**.

The FIG. 4 best illustrates the preferred embodiment of the overdraw structure 11. The receiver 21 of spaced apart side plates 25 and floor plate 26 with parallel spaced apart guideways 36 form a guide channel-like receiver 21 for the carriage 27 which is also channel-like and is nestably guided by the inner faces of the plates 25 in the receiver. The web portion 37 of the carriage 27 supports the upturned flange portions 38 and the profile of the flanges 38, as seen, in the carriage 27 are wedge-like. Anti-friction inserts 39 in Teflon or like materials and in elongate billets of semi circular cross section are attached to the exterior faces of the upstanding flange plates 38 and they provide anti-friction lubrication, complementing and journalling the desired movement of the carriage 27 in the guideways 36 on the receiver 21. The plastic block 30 with vertical slit openings 40 permits selective snap on connection to the cables 19 and to the tether 29 attached to the carriage 27 at post 41.

In the FIG. 5 taken on line 5—5 of FIG. 4, the normal rest position of the carriage 27 is best understood. The spring 34 secured at one end to the web portion 37 secured at one end to the web portion 37 of the carriage 27 and to the floor plate 26 of the receiver structure 21 at the other end urges the carriage 27 fully forward to stop engagement with the barrier 35 at the forward end of the guiding 36 at the Teflon lineal bearing block 39 when the spring 34 is fully retracted. In FIG. 5 the carriage 27 is not at rest against the barrier 35 so that the one of the guide slots or ways 36 is visible, both fore and aft, of the carriage 27. Then, the mode of attachment of the Teflon guide blocks 39 by means of the fasteners 42 can be appreciated.

In operation, the overdraw 11 is easily attached to a bow 12 at the handle 13 and the gapped arrow rests 28 are adjustable by means of the threaded cap screws 43 on each side which extend through a clearance opening in the flanges 38 of the carriage 27. Screws 43 extend threadably into Teflon arrow guide blocks 4—4 having tapered opposed tips 45 (FIGS. 4 and 5) and of such a selected length as to provide a selected gap 46 therebetween. The arrow guide block 44 may be variously configured especially at the tips so as to provide minimal guide contact with the arrow 16 and minimal frictional engagement with the arrow 16 while allowing free passage of the fletching 17 of the arrow 16 in its line of flight.

The overdraw structure 11 is a composite of aluminum plates secured to form the generally elongate and channel shaped receiver 21. This may be constructed of a single or integrated element as by casting or injection molding in metal or in plastic material or of composite resin and graphite or metal filled resin in an integral form. The carriage 27 may also be injection molded of formed in resin or metal and fitted with journals or ways with bridging anti-friction journal elements as between the receiver 21 and the carriage 27.

The tether connector block 30, while preferably in nylon resin may be formed in polyethylene or other similar resins having a tough resilience for snap fitting to the cables 19 of the compound bows 12. The tether 29 is preferably a strong but braided metal or nylon-like leader material adjustably lengthened and shortened at the block 30 or preferably at the post 41 to accommodate the draw matching the selected length of arrow 16.

Functionally, the draw of the compound bow is made to selectively extend the arrow rest of the overdraw structure rearwardly in the present invention and to alter the frictional support relationship from a static position of rest to a controlled dynamic support with movement concurrent with the movement of the arrow and the movement in a controlled path parallel to the line-of-sight with reduced friction toward the end of an improved power delivery; extended arrow selection; and improved repetetive accuracy per given bow.

While a left hand unit is illustrated, the same structure may be adapted for right hand bows by reversing the structural elements of the illustrated overdraw structure.

The carriage may be separately cast and variant guide arrangements of an anti-friction character may be provided in the ways of slots. The receiver may be formed integrally in avoidance of a compound construction. The various components, while in the preferred embodiment of metal, may be made of selected plastic or resin material of equal strength and durability. The return spring means may, for example, be pneumatic or hydro-pneumatic and the arrow guides, while providing clearance for fletching, may be variously configured and fashioned from selected low friction materials.

Having thus described my invention and a preferred embodiment thereof, those familiar with the art and apparatus of archery will perceive obvious changes, modifications and improvement within the skill of the art and such changes, modifications and improvements are intende to be included herein limited only by the scope of my hereinafter appended claims.

I claim:

1. An overdraw structure for archery bows comprising:

a receiver for adjustably mounting to a bow and having guide means to establish relatively frictionless lineal movement and stop means;

a carriage under a resilient bias against said receiver stop means in a forward direction in a control path by said guide means of said receiver and guided by said receiver for relatively frictionless lineal rearward movement and biased return and including adjustable arrow support means; and means of selected length attached to said carriage and connectable to said archery bow and at a predetermined amount of draw moving said carriage in the direction of draw against said resilient bias and, upon release of said draw, said carriage returning in said guide means to rest against said receiver.

2. In the combination of claim 1 wherein said means of selected length is a cable tether.

3. In the combination of claim 2 wherein said cable tether is adjustably attached to a cable connecting block.

4. In the combination of claim 1 wherein said guide means comprises parallel spaced-apart slots in said receiver and Teflon bearing surfaces in said slots.

5. An overdraw structure for a compound bow comprising:

a receiver bracket selectively and adjustably attached to said bow and having spaced apart guide ways extending rearwardly from said bow and having a forward barrier;

a carriage limitedly movable in said ways and biased against said forward barrier, said carriage including arrow support means movable with said carriage as defined by said guide ways; and a tether means adjustably attached to said carriage and to moving elements of said bow whereby said carriage is movable as said bow is flexed in drawing said bow.

6. An overdraw attachment for compound bows having high energy cam wheels which reduce the draw load as the drawstring is moved rearwardly by the archer comprising:

a receiver bracket adjustably secured to said bow at the handle portion thereof, said receiver including a pair of relatively frictionless ways and a forward stop means;

a carriage limitedly movable in said ways said carriage having a pair of relatively friction free arrow rest elements and adjustably extendable across the axis of movement defined by said ways;

resilient bias means urging said carriage against said forward stop means of said receiver; and an adjustable tether element whereby selected rearward draw movement of said bow acts on said tether and moves said carriage rearwardly on said ways and against said bias, the arrow rest moving correspondingly rearwardly with said carriage.

7. An overdraw attachment for compound bows having at least one draw string and cable elements comprising:

an elongate channel-like receiver having a slotted extension providing vertical adjustable attachment of said receiver to said bows, said receiver provided with a pair of spaced apart ways;

a carriage in said ways, said carriage confined by said ways to a lineal path parallel to the length of said receiver;

a barrier, limiting forward movement of said carriage;

spring means connected between said receiver and said carriage and normally biasing said carriage against said barrier;

a tether having length adjustment means and secured to the end of said carriage opposite said barrier and attachably connected to said cable elements of said compound bow whereby said carriage is smoothly and selectively movable in said ways rearwardly of said barrier;

gapped arrow support means having anti-friction support tips extending adjustably and transverse of the length of said carriage, said arrow support means movable with said carriage as said carriage is displaced by said tether as the drawstring movement of said bows acts upon the tether, thereby providing rearward movement to said arrow support as the bow is drawn and return upon release of said draw string.

* * * * *